United States Patent [19]

Kurkela et al.

[11] 4,274,212

[45] Jun. 23, 1981

[54] FLOW APPARATUS FOR WORK VEHICLES

[75] Inventors: Matti Kurkela, Tampere; Leo Lahtinen, Jyväskylä; Raimo Ylivakeri, Pirkkala, all of Finland

[73] Assignee: Valmet, Finland

[21] Appl. No.: 85,296

[22] Filed: Oct. 16, 1979

[30] Foreign Application Priority Data

Oct. 19, 1978 [FI] Finland ..... 783192

[51] Int. Cl.[3] ..... E01H 8/04; E02F 5/22

[52] U.S. Cl. ..... 37/29; 37/35; 37/105

[58] Field of Search ..... 37/29, 35, 36, 41 R, 37/50, 104, 105

[56] References Cited

U.S. PATENT DOCUMENTS

| | | | |
|---|---|---|---|
| 520,284 | 6/1895 | Tremper et al. | 37/29 |
| 2,184,046 | 12/1939 | Karinshak, Jr. | 37/35 X |
| 2,584,675 | 2/1952 | Dangerfield | 37/29 X |
| 3,305,952 | 2/1967 | Dressler | 37/29 X |

FOREIGN PATENT DOCUMENTS

| | | | |
|---|---|---|---|
| 2160492 | 6/1973 | Fed. Rep. of Germany | 37/35 |
| 53735 | 2/1979 | Finland | 37/104 |

*Primary Examiner*—E. H. Eickholt

*Attorney, Agent, or Firm*—Steinberg & Raskin

[57] ABSTRACT

Plow apparatus for work vehicles, particularly of the type which travel on rails, including at least one plow plate pivotally mounted on a respective end of the vehicle in a manner such that the plow plate can be pivoted through an angle of about 180° between a front plowing position in the track of the vehicle and a slide plowing position on the side of the vehicle. The plow plate is pivotally mounted about a vertical axis which is laterally offset to one side of the center-line of the vehicle. In this manner, as the direction in which the vehicle is driven is changed, the plow plate can be pivoted from the front plowing position to the slide plowing position and vice versa. Preferably, such a plow plate is mounted on each end of the vehicle, each plow plate being pivotable about a vertical axis which is offset to the opposite sides of the vehicle center-line.

7 Claims, 3 Drawing Figures

FLOW APPARATUS FOR WORK VEHICLES

BACKGROUND OF THE INVENTION

This invention relates generally to plow apparatus for work vehicles, especially of the type that travel on rails and, more particularly, to such plow apparatus which includes at least one plow plate which can be turned around a verticle axis.

Several different arrangements are known whereby plow plates are associated with work vehicles such, for example, as for snow plowing purposes. Generally, a wedge or V-shaped plow plate is commonly used on the front ends of work vehicles. Further, other various configurations of plates adapted to push material are known in addition to such V-shaped plow plates. It is known to provide such plow or push plates on the front of the work vehicles so as to operate on the track of the vehicle, i.e., directly across the path or direction of movement of the vehicle. It is not uncommon for such plow plates to be mounted on the front of the vehicle so as to be turnable around a horizontal axis as the direction in which the work vehicle is changed.

In the case of plow apparatus specifically adapted to plow snow from railroad tracks, there are essentially two different arrangements which are presently in use. One such arrangement comprises the use of a separate snow plow carriage or "box" plow. Such a snow plow carriage is usually manned by a crew whose personnel attends to the plowing operations. A snow plow carriage of the type described is associated with the front end of the vehicle, in this case a locomotive engine, and the carriage performs both the so-called V-plowing as well as the so-called slide plowing, i.e., plowing along the side area of the vehicle. However, snow plow carriage apparatus of this type has the disadvantage of having relatively high cost of manufacture as well as a high operating cost.

The second arrangement which is frequently utilized in connection with plowing snow from railroad tracks comprises the mounting of a V-plow upon the front end of the engine in conjunction with so-called slide blades which are mounted upon each side of the engine. However, this arrangement is not always practical and, additionally, is relatively expensive due to the necessity of providing several plowing plates for its operation.

Plowing arrangements are known wherein a plowing plate is mounted upon the respective ends of a work vehicle. For example, Finnish Patent Application No. 3177/67 discloses a snow plow for a railroad engine in which a plow plate having a turnable blade is mounted upon each end of the engine. In this case, the blade or snow plow can be turned to a certain desired position such as by means of a hydraulic cylinder in a manner such that the snow plow functions as a so-called diagonal plow. However, even in such arrangements, it is necessary to mount separate slide blades on each side of the engine in order to insure a sufficiently large width for the plow to pass.

SUMMARY OF THE INVENTION

Accordingly, one object of the present invention is to provide new and improved plow apparatus for use in combination with a work vehicle which has an improved operation relative to conventional plow arrangements and which overcomes the drawbacks of such conventional arrangements as described above.

Another object of the present invention is to provide a new and improved snow plow arrangement for use with work vehicles which requires a minimum of plow plates and yet which provides a sufficient width for the plow to pass.

Another object of the present invention is to provide a new and improved plow apparatus for use in connection with work vehicles which facilitates a changing of the plowing direction. An additional object of the present invention is to provide new and improved plow apparatus having the capability of controlling the width of the plowed path as well as an avoidance or evasion of obstacles or blocks in the plowed path.

Briefly, in accordance with the present invention, these and other objects are attained by providing in combination with a work vehicle such, for example, as a railroad engine, a plow assembly wherein a plowing plate is pivotally mounted on at least one end of the vehicle in a manner such that it can be truned about a vertical axis through an angle of about 180° so that its position can be changed from a front plowing position, i.e., a position wherein it traverses the track of the work vehicle, to a slide plowing position wherein it is located on the side of the work vehicle and vice versa. Such a change of positions is effected as the direction of the work vehicle reverses. In the illustrated embodiment, a plow plate is mounted on each end of the work vehicle in a pivotal manner, each of the plow plates being pivotally mounted about a vertical axis which is laterally offset on opposed sides of the center-line of the vehicle so that when the vehicle travels in one direction, one of the plow plates is positioned to constitute the front plowing plate while the other is positioned to constitute a slide plow plate. Upon the direction of the vehicle reversing, the respective plow plates can be changed or reversed in position so that the original front plow plate will function as a slide plow plate whereas the original slide plow plate will now function as the front plow plate.

Several important advantages are obtained by the particular arrangement described above. More particularly, snow plow apparatus constructed in accordance with the present invention is exceedingly simple in construction and economic in manufacture and, additionally, have a relatively low operating cost. Despite the relatively uncomplicated structure of the present invention, its use insures a relatively substantial width of the plowed path, the width being controllable by means of the plow plate which functions as the slide plow over a relatively wide range. In this manner, plow apparatus according to the present invention have the capability of evasion or avoidance of obstacles or blocks in the plowed path. Additionally, such construction facilitates a change in the plowing direction in a manner heretofore not possible with conventional apparatus.

DESCRIPTION OF THE DRAWINGS

A more complete appreciation of the present invention and many of the attendant advantages thereof will be readily appreciated as the same becomes better understood by reference to the following detailed description when considered in connection with the accompanying drawings in which.

DESCRIPTION OF THE PREFERRED EMBODIMENT

Figure 1:
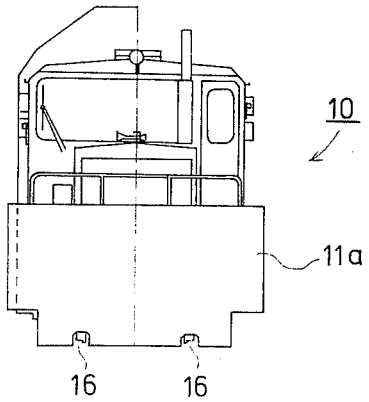
FIG. 1 is a front elevation view of a plow assembly constructed in accordance with the present invention, in combination with a locomotive engine.
Figure 2:
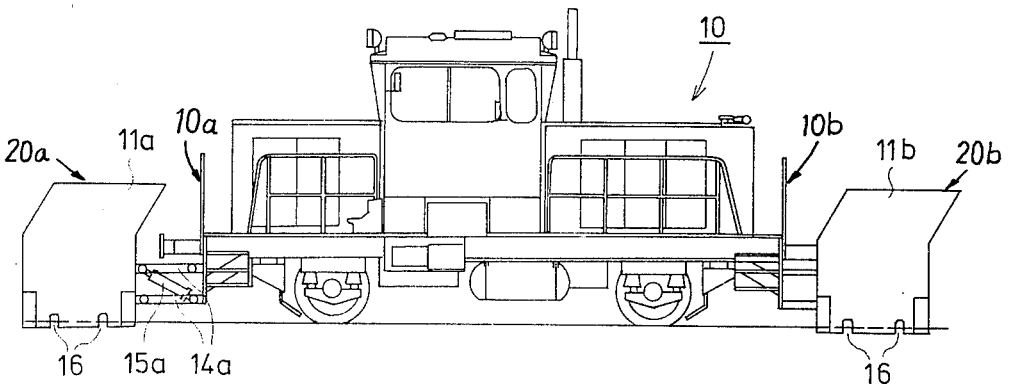
FIG. 2 is a side elevation view of the combination illustrated in FIG. 1.

Referring now to the drawings wherein like reference characters designate identical or corresponding parts throughout the several views, a work vehicle for use in combination with the present invention which in the present embodiment comprises a locomotive engine, generally designated 10, adapted to ride over rails is illustrated. However, it is understood that the present invention has applicability in combination with work vehicles of othertypes including those not adapted to run over rails. According to the illustrated best mode, the first and second ends 10*a*, 10*b* respectively of the engine are each provided with a plow assembly 20*a*, 20*b*, respectively, these plow assemblies being essentially identical in construction.

Figure 3:
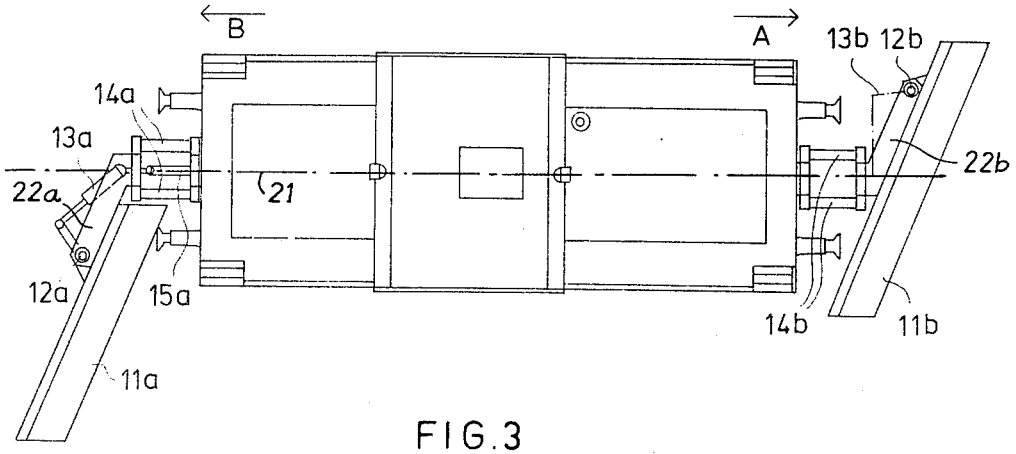
FIG. 3 is a plan view of the combination illustrated in FIG. 1.

Each plow assembly 20*a*, 20*b* includes a respective plow plate 11*a*, 11*b*. Each plow plate 11*a*, 11*b* is mounted so as to pivotable about a vertical axis which is laterally offset from the center-line 21 (FIG. 3) of the engine which extends in the direction of movement thereof. More particularly, in the illustrated preferred embodiment, each plow plate 11*a*, 11*b* is pivotally mounted at bearing points 12*a*, 12*b* respectively, located at the free ends of articulated arms 22*a*, 22*b* respectively. Thus, as seen in FIG. 3 each articulated arm 22*a*, 22*b* has one end affixed to a respective end 10*a*, 10*b* of engine 10 and has a free end which is laterally offset from the center-line 21 of engine 10, the respective free ends of articulated arms 22*a*, 22*b* being laterally offset from the center-line on opposite sides thereof. Further, each plow plate 11*a*, 11*b* is mounted to its respective pivot point 12*a*, 12*b* at a location somewhat displaced from the center of the plate, also as seen in FIG. 3. In this manner, the plow plates 11*a*, 11*b* are articulated acentrically.

Each of the plow plates 11*a*, 11*b* are associated with respective actuating devices which, in the present embodiment, comprise hydraulic cylinders 13*a*, 13*b* respectively, the free end of the piston being associated with appropriate linkages so that upon actuation of the hydraulic cylinders 13*a*, 13*b*, the respective plow plates 11*a*, 11*b* can be turned through an angle of about 180° around the vertical axis on the pivot or bearing points 12*a*, 12*b*, respectively. In this manner, the plow plates 11*a*, 11*b* can be turned to a position within a desired range so that either plow plate 11*a* or 11*b* can function either as a front plow located over the track of the engine 10 or as a slide plow located on the side of the engine. In the embodiment illustrated in FIG. 3, the plow plate 11*b* is located in its front plowing position whereas the plow plate 11*a* is located in its slide plowing position. The actual extent of the operating or pivoting range of the plow plates 11*a*, 11*b* is determined by the distance by which the respective pivot or bearing points 12*a*, 12*b* are laterally offset from the center-line 21 of engine 10. The width of the path which is plowed utilizing this assembly can be controlled by the particular positioning of the plow plate which functions as the slide plow (plow plate 11*a* in the illustrated embodiment) relative to the articulated pivot pont 12.

In the presently illustrated embodiment wherein the plow assembly functions as a snow plow in combination with a engine adapted to ride on rails, the plow assembly is adapted so that its vertical position can be controlled in conjunction with the pivotal location thereof. In this connection, a vertical position control capability is provided by means of respective hydraulic cylinders 15*a*, 15*b*, the ends of the cylinder and piston thereof being respectively connected to the opposed links in a respective rhomboid linkage 14*a*, 14*b*. In this manner, upon actuation of a respective hydraulic cylinder 15, the rhomboid linkage with which it is associated is offset whereby the vertical position of the respective plow plate is suitably adjusted.

It has also been found advantageous in connection with the use of the plow assembly of the present invention in connection with railed vehicles to provide the plow plates 11*a*, 11*b* with a pair of slots or openings 16 formed in the lower edge of the respective plow plate and which are mutually spaced such that when the respective plow plate is positioned in its front plowing position, each opening 16 will be located over and at least partially receive a respective rail on which the engine 10 travels. Further, suitable apparatus (not shown) are provided on each plow plate such that when the latter is positioned to function as a slide plow, the respective openings 16 can be covered. For example, a cover plate can be slidably located over the surface of the plow plate so as to be easily manipulated into a covering relationship with respect to openings 16. It is understood that the provision of such openings 16 are not necessary when the present invention is utilized in connection with work vehicles of the type which are not adapted to ride over rails.

In operation, when engine 10 is travelling in the direction indicated by arrow A in FIG. 3, the plow plate 11*b* is pivoted into its front plowing position wherein it traverses the track of the engine 10 whereas the plow plate 11*a* is positioned so as to function as a slide plow, i.e., is pivoted to a position at the side of engine 10. When the driving direction of engine 10 is reversed, however, the plow plate 11*b* is pivoted about the articulated point 12*b* about 180° and, similarly, the plow plate 11*a*, which originally functioned as the slide plow when the engine travelled in the direction of arrow A, is similarly pivoted about its articulated point 12*a* a distance of about 180° so that the plow plate 11*a* now functions as a front plow. Thus, as engine 10 travels in the direction indicated by arrow B, the plow plates 11*a*, 11*b* are reversed from the positions shown in FIG. 3 so that the plow plate 11*a* functions as a front plow whereas plow plate 11*b* functions as the slide plow.

The present invention results in an extremely fast yet flexible operation. It is understood that the plow plate located at the front of the engine with respect to its particular driving direction will always be located so as to function as a front plow whereas the plow plate located at the rear of the engine with respect to its driving direction will be located so as to function as the slide plow.

Thus, according to the present invention, at least one plow plate is provided on an engine in a manner such that it can be pivoted about a vertical axis through a distance of about 180° so that at one extreme position, the plow plate will function as a front plow and traverse the track of the vehicle and at the other extreme position (obtained upon reversal of the direction of the engine), the plow plate will function as a slide plow located towards the side of the vehicle. In order to vary the width of the plowed path, each plow plate can be located at a position intermediate the two extreme positions.

It is also advantageous to form the plow plate in a manner such that it can plow in two directions. This provides an even greater capability for the plow assembly in that either side of the plow plate may be utilized during the plowing operation so that the plow width can be suitably selected while providing the capability of evasion of obstructions or blocks in the path of the plow.

Obviously, numerous modifications and variations of the present invention are possible in the light of the above teachings. It is therefore to be understood that within the scope of the appended claims, the invention may be practiced otherwise than as specifically disclosed herein.

What is claimed is:

1. In combination with a work vehicle such, for example, as a work vehicle which travels on rails, said work vehicle having first and second ends constituting front and rear ends depending on the direction of movement of the vehicle and a center-line extending in the direction of movement thereof, a plow assembly comprising:

at least one plow plate;

means for pivotally mounting said at least one plow plate on one of said first and second ends of said vehicle so that said plow plate is pivotable through an angle of about 180° between a front plowing position in the track of the vehicle and a slide plowing position on the side of the vehicle about a vertical axis which is laterally offset to one side of said vehicle center-line; and means for pivoting said at least one plow plate, whereby as the driving direction of the vehicle is changed, said plow plate can be pivoted from the front plowing position to the slide plowing position and vice versa.

2. The combination as recited in claim 1 including first and second plow plates pivotally mounted by respective ones of said mounting means on said first and second ends of said vehicle respectively, and each of said plow plates being operatively associated with a respective one of said pivoting means and wherein said first plow plate is pivotally mounted about a vertical axis which is laterally offset to one side of said vehicle center-line and wherein said second plow plate is pivotally mounted about a vertical axis which is laterally offset to the other side of said vehicle center-line, each of said first and second plow plates being pivotal about its respective vertical axis through an angle of about 180° between a front plowing position and a slide plowing position, whereby when said vehicle travels in a direction wherein said first end constitutes the front or leading end thereof, the first and second plow plates are pivoted in said front and slide plowing positions respectively to constitute the front and slide plows respectively and when said vehicle travels in a direction wherein said second end constitutes the front or leading end thereof, said second and first plow plates are pivoted into said front and slide plowing positions respectively to constitute the front and slide plows respectively.

3. The combination of claim 1 wherein said at least one plow plate has a configuration which includes two sides, each of said sides being adapted to function as a plow.

4. The combination of claim 1 wherein said work vehicle is of the type which travels on rails and wherein said at least one plow plate has a bottom edge which in the front plowing position traverses said rails, said bottom edge having a pair of notches formed therein in which said rails are received when said plow plate is positioned in the front plowing position.

5. The combination of claim 1 wherein said at least one plow plate is mounted to said vehicle by said mounting means in a manner such that obstructions or blocks located in the direction of movement of said vehicle can be evaded by actuating said pivoting means.

6. The combination of claim 1 wherein said mounting means comprises an articulated arm one end of which is connected to one of said vehicle ends and the other end of which is laterally offset from said vehicle center-line and pivot pin means located at said other end of said articulated arm to which said plow plate is connected.

7. The combination of claim 1 further including means for vertically raising said plow plate upon actuation of said pivoting means.

* * * * *